United States Patent [19]

Moreno

[11] Patent Number: 4,593,634

[45] Date of Patent: Jun. 10, 1986

[54] APPARATUS AND METHOD FOR JOINING THE PARTS OF SHOE UPPERS BY STITCHING

[75] Inventor: Rodolfo Moreno, Miami Lakes, Fla.

[73] Assignee: Suave Shoe Corporation, Miami Lakes, Fla.

[21] Appl. No.: 659,706

[22] Filed: Oct. 11, 1984

[51] Int. Cl.[4] ..... D05B 21/00

[52] U.S. Cl. ..... 112/262.3; 112/121.12

[58] Field of Search ..... 112/262.3, 262.1, 121.12, 112/121.15, 102, 118

[56] References Cited

U.S. PATENT DOCUMENTS

| | | | |
|---|---|---|---|
| 1,251,677 | 1/1918 | McDonald | 112/121.12 |
| 1,569,231 | 1/1926 | Mayo | 112/121.12 X |
| 1,621,519 | 3/1927 | Sabin . | |
| 1,706,504 | 3/1929 | Warren . | |
| 1,774,620 | 9/1930 | Topham . | |
| 3,034,458 | 5/1962 | Bennison | 112/121.12 |
| 3,172,379 | 3/1965 | Light | 112/121.12 |
| 3,397,418 | 8/1968 | Steadman et al. | 12/146 |
| 3,599,583 | 8/1971 | Berman et al. | 112/121.12 |
| 3,988,993 | 11/1976 | Brophy | 112/121.12 |
| 4,114,545 | 9/1978 | Manabe et al. | 112/121.15 |
| 4,510,876 | 4/1985 | Garley et al. | 112/121.12 X |

*Primary Examiner*—H. Hampton Hunter

*Attorney, Agent, or Firm*—Shapiro and Shapiro

[57] ABSTRACT

A sewing plate, without a cover, is employed to support parts of flexible sheet material that are joined by stitching to form a shoe upper. Pins for locating and holding the parts to be joined project outwardly from one face of the plate about an opening in the plate through which stitching is performed. The flexible material is provided with slits, cut without removal of material, and the slits are pressed onto associated pins. At least some of the pins have a tapered configuration in which the pin cross-section increases progressively from an exposed tip of the pin to a point intermediate the length of the pin and then decreases progressively to the base of the pin.

5 Claims, 4 Drawing Figures

FIG. 1.
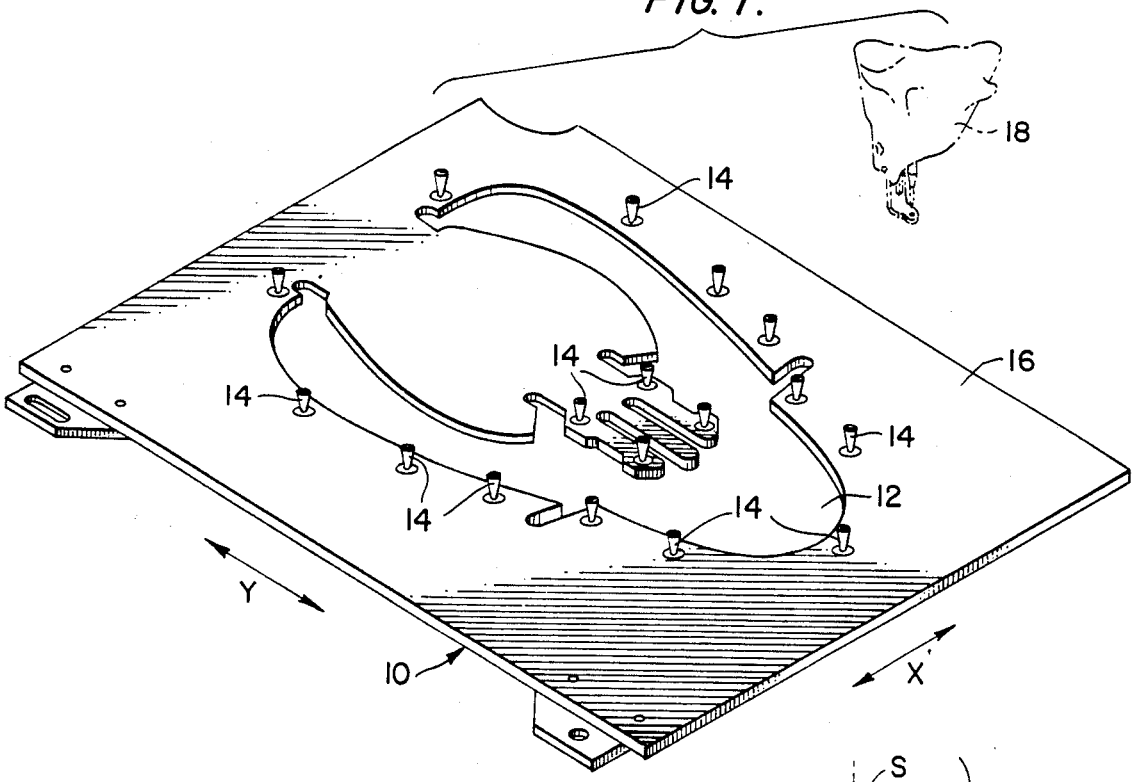
FIG. 2.
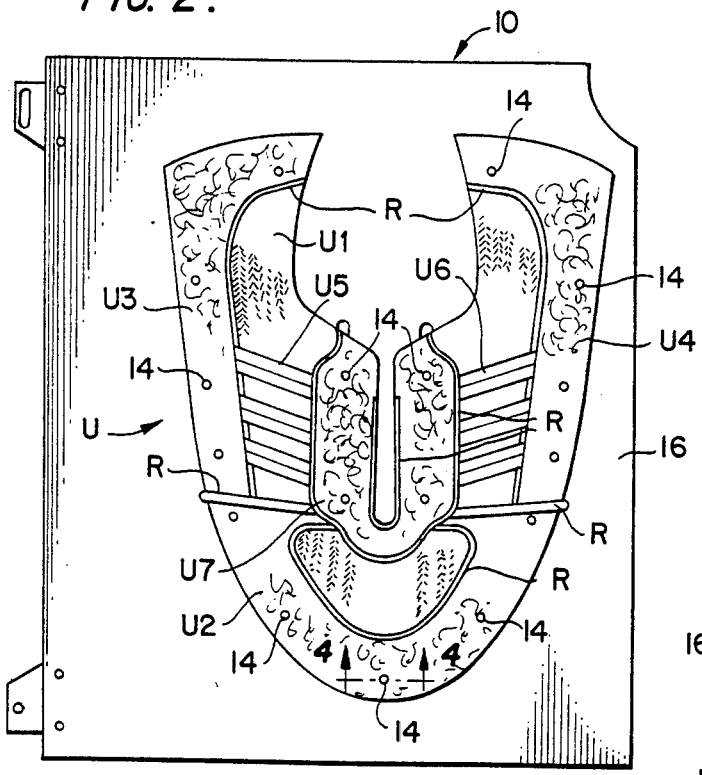
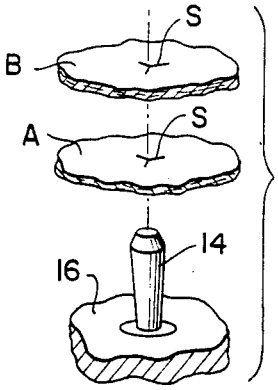
FIG. 3.
FIG. 4.
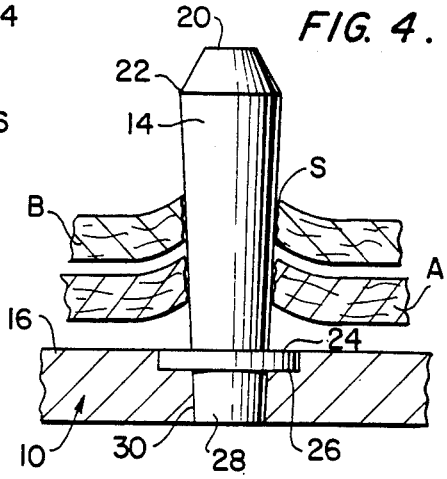

APPARATUS AND METHOD FOR JOINING THE PARTS OF SHOE UPPERS BY STITCHING

BACKGROUND OF THE INVENTION

This invention relates to the manufacture of shoes of the type having uppers comprising parts of flexible sheet material that are joined by stitching.

In the manufacture of shoes of the type employed in athletics, for example, it is common practice to form a shoe upper by assembling a plurality of parts of flexible sheet material, such as parts made of fabric or plastic, and joining them by stitching. In mass production, the stitching is performed by an automatic sewing machine, with the parts to be joined sandwiched between a base plate and a hinged cover plate of a pallet. The pallet includes a template with cavities for locating the parts to be joined, and the pallet is provided with appropriate openings to permit stitching therethrough. After assembly in the pallet of the parts to be joined, the pallet is placed on an X-Y traverse mechanism or carriage that automatically moves the pallet horizontally in two directions while stitching is performed by one or more stitching heads. Although apparatus of this type is capable of excellent performance, the pallets are complex, and the quality of the finished upper is dependent upon the skill of the operator, who is required to position the upper parts to be joined on the pallet with a high degree of accuracy.

BRIEF DESCRIPTION OF THE INVENTION

The present invention provides an improved apparatus and an improved method for use in joining parts of flexible sheet material by stitching. In accordance with the invention, the complexities of sandwich-type pallets are avoided, and the degree of skill required by the operator in positioning the parts to be joined is substantially reduced, thereby reducing the number of defective products and increasing product quality overall.

In one of its broader aspects, the invention is concerned with a support for a workpiece composed of separate parts of flexible sheet material to be joined by stitching, comprising a sewing plate having an opening shaped to permit stitching therethrough in accordance with a predetermined pattern, said plate having a plurality of pins projecting outwardly from one face thereof at positions spaced about said opening, said plate being devoid of a cover, whereby said parts of said workpiece may be pressed over said pins to locate and hold the parts during stitching, with certain parts superposed, and without the need for sandwiching the parts between said plate and a cover.

In another of its broader aspects, the invention is concerned with a method of joining parts of flexible sheet material, comprising providing a support plate having an opening to accommodate stitching therethrough and having pins projecting outwardly from one face of the plate at positions spaced about the opening, providing said parts of flexible sheet material with slits, without removal of material, at positions corresponding to the positions of associated pins, pressing said slits over the associated pins to position said parts on said plate and to superpose certain parts, joining the superposed parts by stitching through said opening with said parts exposed at said face of said support plate and substantially uncovered, and removing the joined parts from said support plate.

The invention will be more fully understood from consideration of the following detailed description in conjunction with the accompanying drawings setting forth a preferred (best mode) and exemplary embodiment.

BRIEF DESCRIPTION OF THE DRAWINGS

FIG. 1 is a perspective (partially diagrammatic) view illustrating a support plate employed in the invention;

FIG. 2 is a plan view of the support plate showing a shoe upper thereon composed of parts of flexible sheet material that have been joined by stitching;

FIG. 3 is a fragmentary exploded view illustrating parts about to be pressed over a locating and retaining pin; and FIG. 4 is a fragmentary cross-sectional view along line 4—4 of FIG. 2 showing the parts on the pin.

DETAILED DESCRIPTION OF PREFERRED EMBODIMENT

As shown in FIG. 1, the invention employs a support plate 10 (which may be termed a sewing plate) having an opening 12 and a plurality of pins 14 projecting outwardly from one face 16 of the plate at positions spaced along the perimeter of the opening 12. As will be seen hereinafter, parts of flexible sheet material to be joined by stitching are placed upon the pins 14 so as to be positioned and held thereby, with certain parts to be joined being superposed. The sewing plate 10 carrying the parts to be joined is then placed upon an X-Y traverse mechanism or carriage (not shown) and moved in orthogonal directions (indicated by arrows X and Y in FIG. 1) relative to stitching means, such as the stitching head 18 shown in phantom. The opening 12 in plate 10 has a shape that permits the parts of the upper to be joined by stitching through the opening in accordance with a predetermined pattern. The general technique of joining the parts of a shoe upper in an automatic sewing machine, but with sandwich-type pallets, is well-known. See, for example, U.S. Pat. No. 3,988,993, issued Nov. 2, 1976, and incorporated herein by reference. In contradistinction to the prior art use of sandwich-type pallets, with the disadvantages noted earlier, the present invention employs a sewing plate that is open (i.e., devoid of a cover). Moreover, the parts to be joined are accurately positioned and retained by the pins 14, rather than by sandwiching the parts between plates.

As shown in FIG. 3, the parts to be joined, illustrated by fragments A and B in FIG. 3, are provided with slits S that are adapted to be pressed over an associated pin 14. The slits are formed by cutting the flexible sheet material with a sharp cutting die (knife) that pierces the part without removal of material therefrom. In the preferred form illustrated in FIG. 3, each slit has a radiating configuration, i.e., a plurality of arms that radiate from a center point. In the form shown, each slit has three arms constituting radii (at 120° intervals) of a circle having a diameter that is slightly larger than the maximum diameter of a projecting pin 14 over which the slit is to be pressed.

As shown in FIG. 4, the pin 14 over which the slits S are pressed by an operator has a tapered configuration. The circular cross-section of the pin increases progressively from an exposed tip 20 to a location 22 intermediate the length of the pin and then decreases progressively to the base 24 of the pin. The base may be a disc that fits within a circular recess 26 of plate 10 and may have a stub 28 that fits within a bore 30 of the plate 10. Each pin may be press-fitted into the support plate.

By virtue of the configuration of the slits S and the pins 14, the slits expand (open) as each slit is forced over the tip 20 of the associated pin and then contract as each slit approaches the base of the pin. This action, which occurs because no material was removed in forming the slits and because of the fact that the material surrounding each slit has a natural tendency to return to an undistorted condition, ensures that the parts of the upper are easily pressed onto the pins and are securely held thereby. The length of each pin is chosen in accordance with the number of separate parts to be superimposed on that pin, and since some portions of the upper may have more superimposed parts than others, the length of the pins at different positions on the sewing plate may vary. Also, if desired, one or more small spring clips may be attached to the face 16 of the sewing plate at discrete locations adjacent to the perimeter of opening 12 so that the edges of certain parts to be joined may be slipped between the clips and face 16 to assist in holding the parts flat against the face.

The invention is not dependent upon a particular number or shape of parts to be joined, all of which are conventional and well known in the manufacture of shoes. FIG. 2 illustrates an upper U composed of a soft inner lining part U1 and stiffer outer parts U2, U3, U4, U5, U6, and U7. The various parts are shown joined by rows R of stitching formed as described in connection with FIG. 1. The completed upper is shown still positioned and held on the pins 14 in FIG. 2, ready to be stripped from the pins by the operator.

By virtue of the invention, the parts of a shoe upper may be joined by stitching in a simple and highly effective manner. Little operator skill is required (compared to the skill required for sandwich pallet devices). To assist an inexperienced operator, the shape of certain parts to be placed on the sewing plate may be outlined on the plate. Although the time required for an operator to place the upper parts on the plate may be slightly greater than that required to place similar parts in a sandwich-type pallet, the amount of defect-free production more than compensates for any loss of time in this regard. Since the slits S are formed without the removal of material, there is no problem with disposal of punched-out pieces. In the prior art this is a serious problem when high speed punching machines are used to form holes in sheet material by punching out pieces of the material. Moreover, it has been found that when slits are formed in accordance with the invention, without removal of material, in many types of sheet material (the types commonly employed as outer layers of uppers) the slits are invisible, the slits tending to close up and "heal" when the upper is removed from the pins. The slits formed on the soft lining material are covered by the outer layers of the upper and cannot be seen in the finished shoe. As is well known, the sole of the shoe may be applied to the upper by an injection-molding operation.

While a preferred embodiment of the invention has been shown and described, it will be apparent to those skilled in the art that changes can be made in this embodiment without departing from the principles and spirit of the invention, the scope of which is defined in the appended claims. For example, the invention may be applied to workpieces other than shoe uppers.

I claim:

1. A support for a workpiece composed of separate parts of flexible sheet material to be joined by stitching, comprising a sewing plate having an opening shaped to permit stitching therethrough in accordance with a predetermined pattern, said plate having a plurality of pins projecting outwardly from one face thereof at positions spaced about said opening, said plate being devoid of a cover, whereby said parts of said workpiece may be pressed over said pins to locate and hold the parts during stitching, with certain parts superposed, and without the need for sandwiching the parts between said plate and a cover.

2. A support in accordance with cliam 1, wherein at least some of said pins have a tapered configuration in which the cross-section of a pin increases progressively from an exposed tip of the pin to a location intermediate the length of the pin and then decreases progressively, whereby a part of said workpiece may be readily pressed onto the pin and then be securely held thereby.

3. A method of joining parts of flexible sheet material, comprising providing a support plate having an opening to accommodate stitching therethrough and having pins projecting outwardly from one face of the plate at positions spaced about the opening, providing said parts of flexible sheet material with slits, without removal of material, at positions corresponding to the positions of associated pins, pressing said slits over the associated pins to position said parts on said plate and to superpose certain parts, joining the superposed parts by stitching through said opening with said parts exposed at said face of said support plate and substantially uncovered, and removing the joined parts from said support plate.

4. A method in accordance with cliam 3, wherein at least some of said slits are formed by cutting radiating patterns through associated flexible sheet material.

5. A method in accordance with claim 3, wherein at least some of said pins are provided with a tapered configuration of cross-section that increases progressively from an exposed tip of the pin to a location intermediate the length of the pin and then decreases progressively, and wherein the slits associated with such pins are initially expanded as the slits are pressed over the pins and then contracted as the slits continue to be pressed over the pins.

* * * * *